United States Patent [19]

Tarko

[11] Patent Number: 4,730,953

[45] Date of Patent: Mar. 15, 1988

[54] INSULATED WATERPROOF DRAINAGE MATERIAL

[76] Inventor: Paul L. Tarko, 383 S. Main St., Windsor Locks, Conn. 06096

[21] Appl. No.: 919,134

[22] Filed: Oct. 15, 1986

[51] Int. Cl.[4] ..... E02B 11/00; E02D 31/02

[52] U.S. Cl. ..... 405/45; 52/169.5; 52/169.11; 405/50

[58] Field of Search ..... 405/43, 45, 50; 52/169.5, 169.11, 169.14; 210/170, 459, 486

[56] References Cited

U.S. PATENT DOCUMENTS

| | | | |
|---|---|---|---|
| 3,654,765 | 4/1972 | Healy et al. | 405/45 |
| 4,309,855 | 1/1982 | Pate et al. | 405/45 X |
| 4,490,072 | 12/1984 | Glasser | 405/45 |
| 4,525,960 | 7/1985 | Kelman | 405/50 X |

*Primary Examiner*—David H. Corbin

*Attorney, Agent, or Firm*—Fishman & Dionne

[57] ABSTRACT

An insulative waterproof drainage material is presented. The insulative drainage system comprises, in part, a plastic sheet having a plurality of alternate valleys and raised portions in the sheet defining a core. Preferably, the core leads to a slotted pipe. The core has two opposing surfaces. One surface has a water previous fabric material attached thereto while the other surface has a layer of thermally insulative material, preferably a polymeric foam material thereon. The foam or other insulative material has a pre-selected thickness which provides a sufficient R (thermal) value. This insulative drainage system is formed into panels and then adhesively applied to the exterior of a foundation or other retaining wall using any suitable and well known adhesive. Preferably, each panel is provided with interlocking joints which permit a watertight fit between adjacent panels.

10 Claims, 3 Drawing Figures

INSULATED WATERPROOF DRAINAGE MATERIAL

BACKGROUND OF THE INVENTION

This invention relates generally to an insulating drainage device or system for use in removing water in the vicinity of foundations or the like as well as providing thermal insulation to the foundation.

In order to maintain basement interiors dry and moisture free, it is necessary to remove water penetrating the soil mass adjacent the subterranean walls quickly, while avoiding a decrease in the strength of the soil "piping" or pore pressure. Such removal is often accomplished hy means of drainage systems comprising drainage pipes surrounded by a mineral aggregate. The particle size distribution of the aggregate must be carefully matched to the native soil in the region of construction. The functions of a properly designed drainage system are to remove water from the surrounding soil while "filtering" preventing movement of soil particles therefrom. Many of the prior art drainage systems as discussed hereinabove suffer from significant deficiencies and disadvantages caused by clogging or other malfunctioning.

U.S. Pat. Nos. 3,563,038, 3,654,765 and 4,490,072 (all three prior patents being fully incorporated herein by reference) overcome the significant problems of prior art drainage systems by disclosing drainage devices of the type which include a drainage pipe provided below a core surrounded by a ground water previous material to provide a pathway for the water through the core into the drainage pipe. The drainage device disclosed in these three patents are well known by the terms subterranean wall drain, drainage system or composite curtain drain. Drainage systems of this type are commercially marketed by the ELJEN CORPORATION of Storrs, Conn. Typically, this drainage system comprises an envelope of a nonwoven filter material having a core which leads to a pipe inside the water previous nonwoven material. This core comprises a plastic sheet having a plurality of alternate valleys and raised portions defined in the sheet. Preferably, this core leads to a slotted pipe. During use, water enters the previous envelope material, flows downwardly along the corrugated hills and valleys of the plastic core material and then enters into the slotted pipe to be carried away from the hillside, foundation or filtration system. Thus, as so constructed, the drainage device of the prior patents are well adapted to handle the downward flow of water beneath the surface of the ground in a drainage system or a septic system filter such that normal hydrostatic pressure will force this water inwardly through the water permeable filter material and into the valleys defined in the core where gravity carries the water downwardly to the drainage pipe and more particularly to the slotted openings in the drainage pipe.

In an effort to improve the thermal insulative properties of buildings (so as to decrease energy costs), the construction industry routinely applies sheets of insulative material, typically polymeric foam sheets, to the outside foundation walls prior to backfilling. Generally, these foamed sheets (i.e., polyurethane) are adhesively applied to the cement or concrete foundation walls of the building. Often, a waterproofing material is applied between the foundation wall and the insulative sheets. This waterproofing material may consist of, for example, volclay panels, urethane modified tar coatings or adhesive backed rubber sheets.

While suitable for its intended purposes, one drawback of the drainage system disclosed in the three previously discussed patents is that little, if any, insulation is provided therefrom. In view of the widespread use of insulative sheets for foundation exteriors, there is a perceived need for providing a suitable water drainage system which also provides thermal insulation to the foundation, cellar wall or other retainer wall to which it is associated.

Presently, three separate layers are often used around the outside of foundation walls. The first layer comprises a waterproofing material applied on the foundation walls. This waterproofing material may consist of, for example, volclay panels, urethane modified tar coatings or adhesive backed rubber sheets. The second layer comprises the insulative sheet and the third layer comprises a suitable drainage system such as stone aggregate and pipe or the drainage system disclosed in the foregoing patents. Thus, these three separate layers entail three distinct labor intensive assemblies along with the purchasing and stocking of the various materials leading to high labor and purchasing costs.

SUMMARY OF THE INVENTION

The above-discussed and other drawbacks and deficiencies of the prior art are overcome or alleviated by the insulative waterproof drainage material of the present invention. In accordance with the present invention, an insulative drainage system comprises, in part, a plastic sheet having a plurality of alternate valleys and raised portions in the sheet defining a core. Preferably, the core leads to a slotted pipe. The core has two opposing surfaces One surface has a water previous fabric material attached thereto while the other surface has a layer of thermally insulative material, preferably a polymeric foam material thereon. The foam or other insulative material has a pre-selected thickness which provides a sufficient R (thermal) value.

The insulative drainage system as described above is formed into panels and is then adhesively applied to the exterior of a foundation or other retaining wall using any suitable and well known adhesive. Preferably, each panel is provided with interlocking joints which permit a watertight fit between adjacent panels; thereby resulting in waterproof insulation around the cellar or retainer wall.

The insulative drainage and waterproofing system of the present invention will thus provide a pathway for ground water away from the building or other structure's foundation wall as well as providing a sufficient degree of thermal insulation and waterproofing. Moreover, the present invention is relatively inexpensive to produce and easy to install.

The above-discussed and other features and advantages of the present invention will be understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
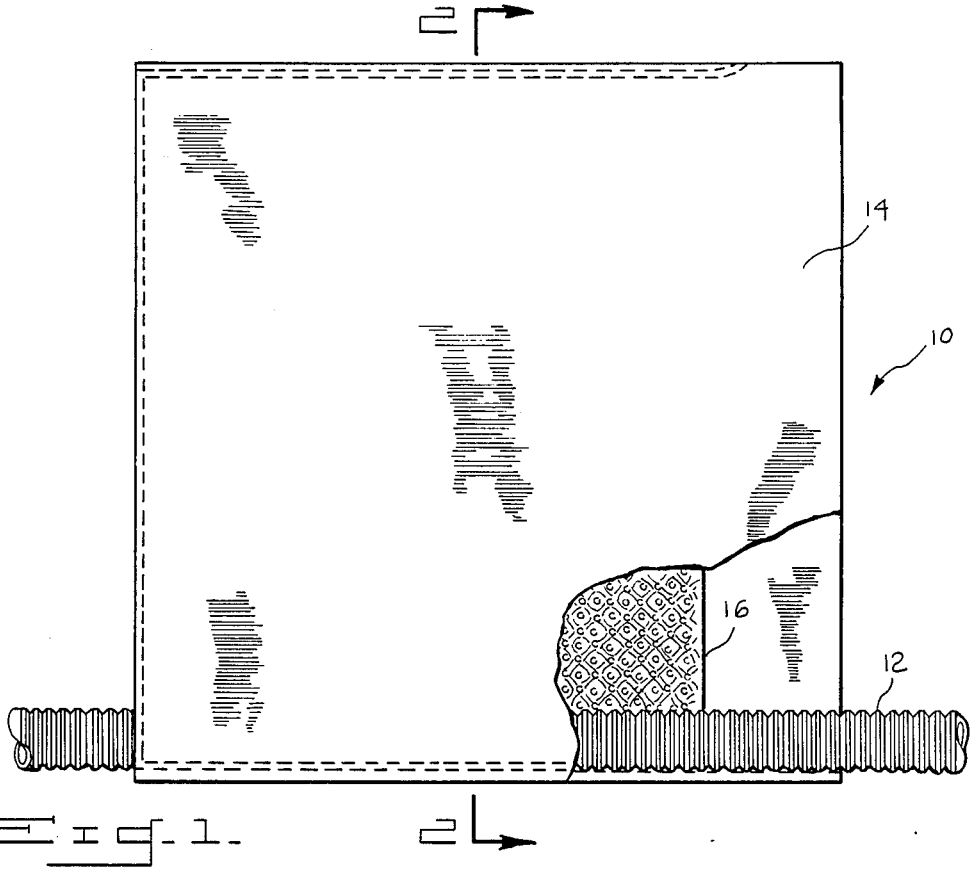
FIG. 1. (PRIOR ART)
FIG. 1 is a side elevation view, partly broken away, of a drainage device in accordance with the prior art.
Figure 2:
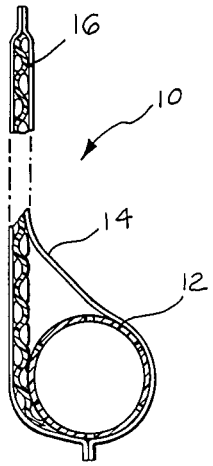
FIG. 2. (PRIOR ART)
FIG. 2 is a cross sectional elevation view along the line 2—2 of FIG. 1.

Referring first to FIGS. 1 and 2, a drainage system for carrying away subsurface water of the type shown in U.S. Pat. Nos. 3,563,038, 3,654,765 and 4,490,072 is shown generally at 10. Prior art drainage system 10 includes a slotted drainage pipe 12 which extends through a preferably nonwoven thermal plastic envelope material shown generally at 14. Envelope 14 has opposed faces 14A and 14B stitched to one another at the top 14C and bottom 14D to provide an envelope for receiving pipe 12 as is best shown in FIG. 2. Inside envelope 14, a core or armature 16 is provided along side pipe 12, and is generally transversely arranged with respect to pipe 12. Core 16 serves several functions such as providing a separation between the opposed front and back layers 14A, 14B of the nonwoven filter material making up the envelope 14; and to provide a convenient assembly of the filter material 14 with the pipe 10 in order to provide a plurality of passageways for the downwardly flowing ground water and to direct this water into the corrugations or valleys defined by core 16 and then into the slots defined in pipe 12 so that the water can be carried away inside the pipe in a conventional fashion to a catch basin or the like. Core 16 comprises a plastic sheet which has been formed by passing it between appropriately configurated mandrels in a suitable machine (not shown) while the plastic is in a heated condition so that alternate valleys and raised portion are defined in the sheet as shown in the drawing. The plastic sheet (core) is preferably formed from a plastic material such a polystyrene having a thickness of between 15 and 45 mils, preferably on the order of 1/32 of an inch in thickness.

As so constructed, the drainage device in accordance with the prior art as shown in FIGS. 1 and 2 is well adapted to handle the downward flow of water beneath the surface of the ground in a drainage system or a septic system filter such that normal hydrostatic pressure will force this water inwardly through the water permeable filter material 14 and into the valleys defined in the core 16 where gravity carries the water downwardly to the drainage pipe and more particularly, to the slotted openings in the drainage pipe 12 as described above.

While well suited for its intended purposes, when the drainage system of the prior art is used in association with the wall of a foundation or other retaining structure, the prior art drainage system is incapable of providing any appreciable thermal insulation to the retainer or foundation wall nor will it provide complete waterproofing. As there is an increasing need to provide such insulation on the exterior wall of foundations or other retaining structures or waterproofing, it would be particularly advantageous for a drainage system to not only carry away subsurface water, but also to provide an adequate degree of thermal insulation to the foundation.

Figure 3:
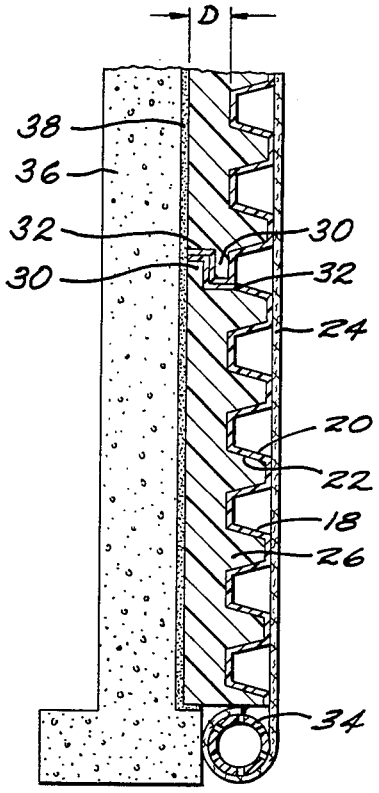
FIG. 3 is a cross sectional elevation view of an insulated waterproof drainage system in accordance with the present invention.

Turning now to FIG. 3, in accordance to the present invention, a drainage system similar to the drainage system shown in FIGS. 1 and 2 is provided with improved structural features so as to render it capable of both water drainage as well as thermal insulation and waterproofing. The insulated drainage material of the present invention comprises a formed plastic core 18 having a corrugated surface with raised hills and recessed valleys similar to the core identified at 16 in FIGS. 1 and 2. Core 18 includes an outer surface 20 and an inner surface 22. The extended surfaces or hills of core 18 have a layer of permeable fabric material 24 preferably adhesively applied thereto. Again, water permeable material 24 on outer surface 20 of core 18 is similar to the permeable envelope identified at 14 in FIGS. 1 and 2.

An important feature of the present invention is the presence of thermally insulative material 26 which is applied to the interior surface 22 of core 18. Insulative material 26 may be comprised of any suitable material having a sufficiently high thermal R value and is preferably comprised of a foamed polymeric material such as a polyurethane or polystyrene. As shown in FIG. 3, the insulative material has a selected thickness whereby it not only totally fills in the undulating or corrugated valleys of core 18, but also, is thick enough to be spaced back a distance D from an extending hill. It will be appreciated that the resultant insulative R value of insulation layer 26 will be dependent upon the thickness D. Insulation 26, core 18 and permeable fabric 24 are attached to one another to form discrete panels. At least one end of each of these panels is provided with some interlocking means or joint so as to effect a tight, waterproof interlocking fit with an adjacent panel as shown in FIG. 3. In the illustrative embodiment shown, joints are identified at 28 as interlocking protrusions 30, each protrusion 30 having an adjacent shoulder 32 for accepting a protrusion 30 from another panel. Finally, the insulative drainage system of the present invention also includes a slotted or otherwise perforated drain pipe shown generally at 34 which is positioned along the bottom of the panels. It will be appreciated that permeable fabric 24 is preferably wrapped about pipe 34 so as to hold pipe 34 in a desired position as well as aiding in directing water drainage.

In FIG. 3, a foundation or retaining wall is identified at 36. The interlocking insulative drain panels of the present invention are brought into contact with foundation wall 36 and attached thereto by a suitable adhesive 38. The preferred adhesive 38 comprises a urethane modified tar coating which functions both as a waterproof coating on foundation wall 36 as well as an adhesive for securing the insulative drainage panels to the foundation wall 36. Alternatively, a waterproof adhesive material may be applied on the insulative material using a peel back release paper for ease of application rather than the adhesive being coated onto the wall in a separate process step.

During use, ground water which flows towards foundation wall 36 will contact permeable fabric covering 24 and then flow downwardly along the corrugated hills and valleys of core 18 finally flowing into slotted pipe 34. Thereafter, the water will flow away from the building in a known manner. Simultaneously, the water drainage system as shown in FIG. 3 will also provide thermal insulation to foundation walls 36. This insulation will be determined by the material used for insulation and the thickness thereof. Of course, by tailoring the insulative material and thickness, any desired degree of thermal insulation may be obtained. Thus, the raised hills and valleys on core 18 will manage the water and drain it both vertically and horizontally away from the soil and foundation. In fact, it will be appreciated that the present invention actually eliminates the hydrostatic pressure from the surrounding soil and lowers the water table around the foundation. Moreover, the preferably foamed insulative backing will provide an insulation to the foundation wall and the adhesive coating between the foundation and foamed insulation will act as both waterproofing as well as an adhesive between the panel and wall. As the adhesive, insulative material, and core 18 are all waterproof, no water will be able to reach the concrete wall. Thus, as no water pressure is provided to the concrete wall, no cracks or other similar damage will result due to the elimination of the hydrostatic pressure.

While a preferred application of the present invention has been a combined insulative drainage material, the structure of FIG. 3 could also function as a building panel which would be rigid, insulative and mechanically strong. When used as a building panel, the permeable filter cloth would be replaced with fiberglass and cloth impregnated with a glue followed by a polymeric (polyester) coating. The remaining panel structure would remain the same as in FIG. 3.

While preferred embodiments have been shown and described, various modifications and substitutions may be thereto without departing from the spirit and scope of the invention. Accordingly, it is to be understood that the present invention has been described by way of illustrations and not limitation.

What is claimed is:

1. An insulative waterproof drainage material comprising:

a sheet of rigid material having a plurality of hills and valleys therein to define a core, said core having opposed surfaces;

permeable fabric material attached to one of said opposed surfaces;

a layer of thermally insulative material on said other of said opposed surfaces, said insulative material having a first surface covering said hills and valleys and having a second surface oppositely disposed from said first surface defining an outer surface, said outer surface being spaced a pre-selected distance D from said hills of said core, said pre-selected distance D defining an insulative material thickness corresponding to a pre-selected thermal value.

2. The material of claim 1 including:

adhesive material on said outer surface of said thermally insulative material.

3. The material of claim 1 including:

a slotted pipe along said core.

4. The material of claim 1 wherein:

said thermally insulative material is a foamed polymeric material.

5. The material of claim 4 wherein:

said foamed polymeric material is polyurethane or polystyrene.

6. The material of claim 1 wherein:

said core, permeable fabric and insulative material define at least one panel and including:

means for interlocking said panel with another panel.

7. The material of claim 6 wherein said interlocking means comprises:

said panel having an edge and wherein said edge includes a protrusion and a shoulder, said shoulder being adjacent said protrusion.

8. The material of claim 2 wherein:

said adhesive is water proof.

9. The material of claim 8 wherein:

said adhesive is a urethane modified tar coating.

10. The material of claim 1 wherein:

said core is comprised of a plastic material.

* * * * *